US007192530B2

(12) United States Patent
Ryu et al.

(10) Patent No.: US 7,192,530 B2
(45) Date of Patent: Mar. 20, 2007

(54) METHOD OF MANUFACTURING DISTRIBUTED ANALOG PHASE SHIFTER USING ETCHED FERROELECTRIC THIN FILM

(75) Inventors: Han Cheol Ryu, Seoul (KR); Seungeon Moon, Daejeon (KR); Min Hwan Kwak, Jinju (KR); Su Jae Lee, Daejeon (KR); Sang Seok Lee, Daejeon (KR); Young Tae Kim, Seoul (KR)

(73) Assignee: Electronics and Telecommunications Research Institute (KR)

( * ) Notice: Subject to any disclaimer, the term of this patent is extended or adjusted under 35 U.S.C. 154(b) by 88 days.

(21) Appl. No.: 10/796,628

(22) Filed: Mar. 8, 2004

(65) Prior Publication Data

US 2005/0040915 A1 Feb. 24, 2005

(30) Foreign Application Priority Data

Aug. 18, 2003 (KR) ..... 10-2003-0056847

(51) Int. Cl.
*H01P 1/18* (2006.01)

(52) U.S. Cl. ..... 216/13; 216/66

(58) Field of Classification Search ..... None
See application file for complete search history.

(56) References Cited

U.S. PATENT DOCUMENTS 4,077,113 A * 3/1978 Papuchon ..... 29/600
5,237,629 A * 8/1993 Hietala et al. ..... 385/3
5,854,870 A * 12/1998 Helmfrid et al. ..... 385/122
6,069,729 A * 5/2000 Gill et al. ..... 359/245
6,531,936 B1 3/2003 Chiu et al.
6,538,603 B1 3/2003 Chen et al.
6,559,737 B1 5/2003 Nagra et al.
6,839,489 B2 * 1/2005 Switzer et al. ..... 385/40
2002/0048076 A1 * 4/2002 Kondo et al. ..... 359/322
2002/0118079 A1 * 8/2002 Whatmore et al. ..... 333/189

OTHER PUBLICATIONS

"Microwave Performance of Distributed Analog Phase Shifter Using Ferroelectric (Ba, Sr) TiO3 Thin Films", H. Ryu, et al., Mar. 9, 2003, ISIF 2003 Book of Abstracts, 3 pages.
Proceeding of the KIEEME Annual Summer Conference 2003, Design and Fabricaton of Distributed Analog Phase Shifter Using Ferroelectric (Bz, Sr) TiO3 Thin Films, H. Ryu, 17 pages.

(Continued)

*Primary Examiner*—Allan Olsen
(74) *Attorney, Agent, or Firm*—Blakely Sokoloff Taylor & Zafman

(57) ABSTRACT

Provided are a distributed analog phase shifter and a method of manufacturing the same, which reduce a change in a characteristic impedance while changing a phase velocity with respect to an applied voltage. In the distributed analog phase shifter, a coplanar waveguide (CPW) is formed in a line form on a substrate. A plurality of ferroelectric capacitors is periodically loaded to the CPW. The ferroelectric capacitors include a ferroelectric film in a pattern form and defines the ferroelectric film affected by the applied voltage within an area of the ferroelectric capacitors. Accordingly, the change in the phase velocity with respect to the applied voltage is maintained without the change of the CPW characteristic and a return loss characteristic and a total insertion loss are improved since a total dielectric loss of the ferroelectric film is decreased.

5 Claims, 9 Drawing Sheets

OTHER PUBLICATIONS

"Distributed Phase Shifters Using (Ba, Sr) Ti03 Thin Films on Sapphire and Glas Substrates", Y. Liu, et al., Integrated Ferroelectrics, 2001, vol. 39, pp. 313-320.

"Distributed Analog Phase Shifters with Low Insertion Loss", A. Nagra, IEEE Transactions on MIcrowave Theory and Techniques, vol. 37, No. 9, Sep. 1999, pp. 1705-1711.

"Low-Loss Distributed MEMS Phase Shifter" A. Borgioli, et al., IEEE Microwave and Guided Wave Letters, vol. 10, No. 1, Jan. 2000, pp. 7-9.

"Low-Loss Cascadable MEMS Distributed X-Band Phase Shifters", J. Hayden, et al., IEEE Microwave and Guided Wave Letters, vol. 10, No. 4, Apr. 2000, pp. 142-144.

* cited by examiner

METHOD OF MANUFACTURING DISTRIBUTED ANALOG PHASE SHIFTER USING ETCHED FERROELECTRIC THIN FILM

CROSS REFERENCE TO RELATED APPLICATION

This application claims the priority of Korean Patent Application No. 2003-56847, filed on Aug. 18, 2003, in the Korean Intellectual Property Office, the disclosure of which is hereby incorporated by reference in its entirety.

BACKGROUND OF THE INVENTION

1. Field of the Invention

The present invention relates to a phase shifter for use in phased array antennas and a method of manufacturing the same, and more particularly, to a distributed analog phase shifter using an etched ferroelectric film and a method of manufacturing the same.

2. Description of the Related Art

In general, phase shifters are essential core parts of active phased array antennas that trace a satellite to make clear and perfect communications possible on a real-time basis even when the active phased array antennas move in a mobile communication system.

Among such phase shifters, a ferroelectric distributed analog phase shifter controls a phase using a characteristic of a ferroelectric material having a dielectric constant that changes according to the strength of an applied electric field. Since the ferroelectric distributed analog phase shifter is small size and lightweight and has a quick-response characteristic, low dielectric loss, and high power processing capability, it is expected to substitute for currently widely used semiconductor devices.

General ferroelectric phase shifters can be roughly classified into four types: a simple coplanar waveguide (CPW) type, a loaded line type, a type using a variable filter, and a reflective structure type in which variable capacitors are connected to terminals of a coupler.

Conventional ferroelectric distributed analog phase shifters are generally combinations of the CPW type and the loaded line type.

However, in the conventional ferroelectric distributed analog phase shifters, a ferroelectric film having a dielectric constant that changes with an applied voltage occupies the entire surface of a substrate. As a result, a characteristic impedance is significantly changed with a change in a phase velocity that is the most important factor of the ferroelectric distributed analog phase shifter. In other words, since the ferroelectric film having a dielectric constant that changes with an applied voltage is formed over the entire surface of a substrate, the dielectric constant of the ferroelectric film may significantly change, causing changes in not only the phase velocity but also a characteristic impedance. Such changes may have a negative influence upon characteristics of a circuit.

Also, difficulty in extracting design parameters requires a number of repetitive processes. If a high voltage is applied to obtain a desired differential phase shift angle, a large difference in insertion loss occurs due to a change in the applied voltage.

SUMMARY OF THE INVENTION

The present invention provides a distributed analog phase shifter comprising a substrate, a coplanar waveguide (CPW), and a plurality of ferroelectric capacitors. The coplanar waveguide is extended in a line form on the substrate, the plurality of ferroelectric capacitors is periodically loaded to the CPW, and ferroelectric materials of the ferroelectric capacitors are disposed in pattern forms.

The CPW further comprises a ground plane disposed at both sides of a signal line on the substrate and substantially parallel to the signal line.

Also, the plurality of ferroelectric capacitors comprises first electrodes, second electrodes, and ferroelectric materials. The first electrodes are branched from both sides of the coplanar waveguide at predetermined intervals. The second electrodes are extended from a ground line to correspond to the first electrodes. The ferroelectric materials are formed in pattern forms to overlap with the first electrodes and the second electrodes.

The ferroelectric materials are formed of barium strontium titanate. The substrate is formed of one of high-resistance silicon, semi-insulting gallium arsenide, alumina, glass, sapphire, and magnesium oxide.

According to another aspect of the present invention, there is provided a method of manufacturing a distributed analog phase shifter. The method comprises depositing a ferroelectric film on a substrate, etching the ferroelectric film to form ferroelectric patterns, depositing a metal layer on the substrate on which the ferroelectric patterns are formed, and forming a coplanar waveguide, first electrodes, a ground line, and second electrodes by etching the metal layer. The first electrodes and the second electrodes are formed such that portions of the first electrodes and second electrodes overlap with the ferroelectric pattern, respectively.

The ferroelectric film is deposited using pulsed laser deposition. The ferroelectric film is etched using radio frequency ion milling. The metal layer is a deposition layer of gold/chrome. The metal layer is deposited using DC magnetron sputtering.

BRIEF DESCRIPTION OF THE DRAWINGS

The above and other aspects and advantages of the present invention will become more apparent by describing in detail exemplary embodiments thereof with reference to the attached drawings in which.

DETAILED DESCRIPTION OF THE INVENTION

Figure 1:
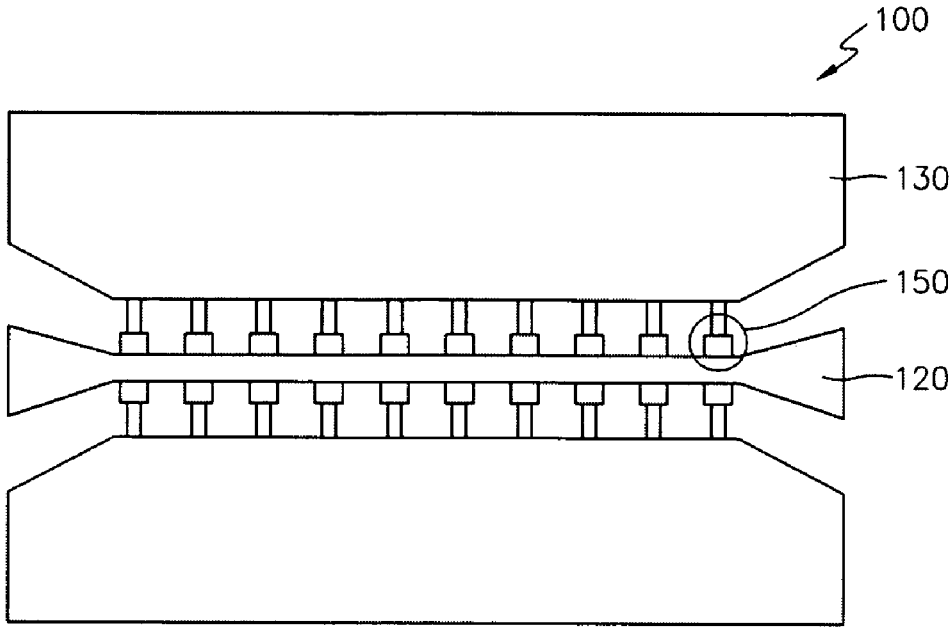
FIG. 1 is a plan view of a ferroelectric distributed analog phase shifter according to an embodiment of the present invention.

The present invention will now be described more fully with reference to the accompanying drawings, in which an exemplary embodiment of the invention is shown. The invention may, however, be embodied in many different forms and should not be construed as being limited to the embodiment set forth herein; rather, this embodiment is provided so that this disclosure will be thorough and complete, and will fully convey the concept of the invention to those skilled in the art. In the drawings, the thicknesses of layers and regions are exaggerated for clarity. Like reference numerals in the drawings denote like elements, and thus their description will be omitted.

In the embodiment of the present invention, in order to minimize the change in a characteristic impedance while maintaining the change in the phase velocity of a ferroelectric distributed analog phase shifter with respect to an applied voltage, a ferroelectric film having a dielectric constant that changes with the applied voltage is formed in a pattern form on the minimum area on a substrate, i.e., only on the area for forming a capacitor. By reducing the area of the ferroelectric film in the ferroelectric distributed analog phase shifter, the change in a characteristic impedance can be reduced without affecting the change in a phase velocity with respect to a voltage change, thereby reducing return loss and insertion loss.

Hereinafter, the ferroelectric distributed analog phase shifter will be described in detail with reference to FIGS. 1 and 2.

As shown in FIG. 1, a ferroelectric distributed analog phase shifter 100 according to the embodiment of the present invention includes a CPW signal line 120 having an input unit and an output unit and ferroelectric capacitors that are periodically loaded to the CPW signal line 120, e.g., an interdigitated capacitor (IDC) 150.

CPW denotes a transmission line having high impedance, i.e., a conductive line. As implied by the name of the IDC 150, the IDC 150 is a ferroelectric capacitor interposed between the CPW signal line 120 and a CPW ground plane 130 and includes a ferroelectric pattern etched to a predetermined size, e.g., a barium strontium titanate (BST) pattern. Such a periodic structure supports slow wave propagation properties.

Figure 2:
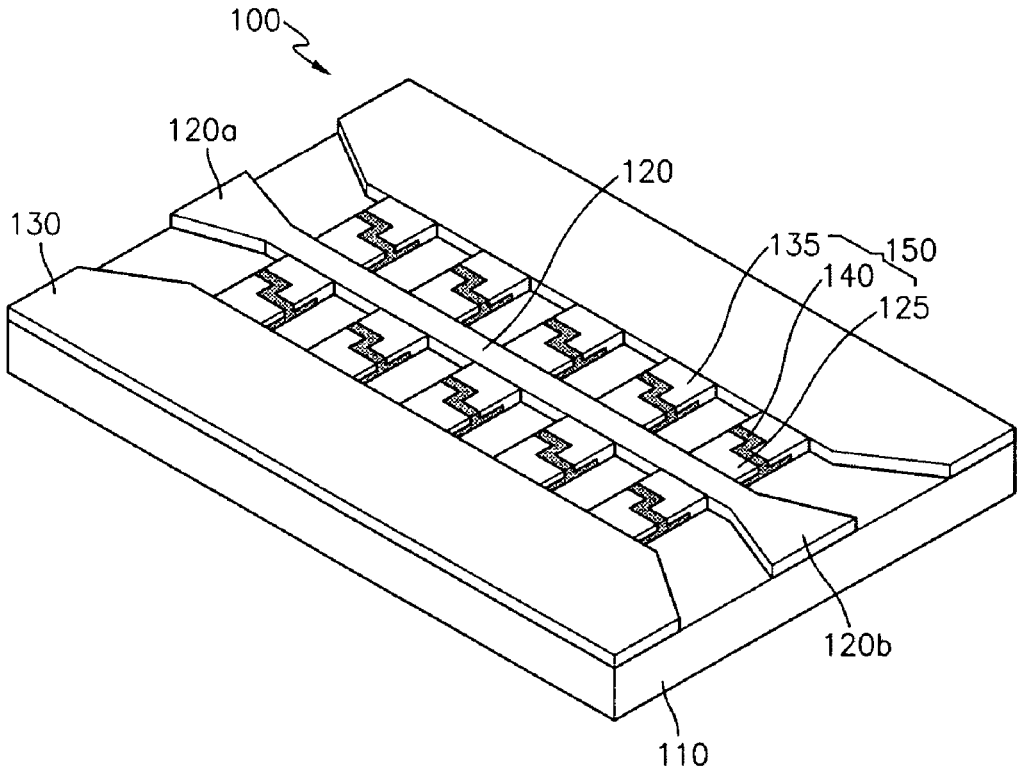
FIG. 2 is a perspective view of the ferroelectric distributed analog phase shifter according to the embodiment of the present invention.

More specifically, as shown in FIG. 2, the ferroelectric distributed analog phase shifter 100 includes a substrate 110. It is preferable that the substrate 110 be formed of one of high-resistance silicon, semi-insulating gallium arsenide, alumina, glass, sapphire, and magnesium oxide. A CPW is disposed in a line form on a predetermined portion on the substrate 110. A radio frequency (RF) input unit 120*a* and an RF output unit 120*b* are formed at two terminals of the CPW and the widths of the RF input unit 120*a* and the RF output unit 120*b* each may be larger than the width of the CPW signal line 120 by a predetermined width. The CPW signal line 120 includes a plurality of first electrodes 125 that are branched from both sides of the CPW signal line 120 at predetermined intervals.

The CPW ground plane 130 is disposed at both sides of the CPW signal line 120 on the substrate 110. The CPW ground plane 130 is apart from the CPW signal line 120 by a predetermined distance and is substantially parallel to the CPW signal line 120. A plurality of second electrodes 135 are formed at predetermined intervals to correspond to the first electrodes 125. The first electrodes 125 and the second electrodes 135 face each other while being apart by a small space.

A ferroelectric pattern 140 etched to a predetermined size is disposed under the first electrodes 125 and the second electrodes 135. The ferroelectric pattern 140 may be a BST film and constitutes the IDC 150 with the first electrodes 125 and the second electrodes 135.

The ferroelectric distributed analog phase shifter 100 can be formed as follows.

Figure 3A:
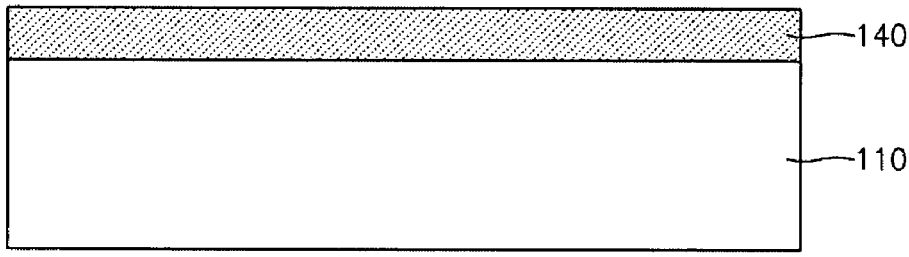
FIGS. 3A through 3E are sectional views of respective processes for explaining a method of manufacturing the ferroelectric distributed analog phase shifter according to the embodiment of the present invention.

First, as shown in FIG. 3A, the ferroelectric film 140, e.g., a BST film, is deposited on the substrate 110. For example, the ferroelectric film 140 is deposited at a pressure of 150–300 mTorr and at a temperature of 700–800° C., using pulsed laser deposition (PLD). For example, the ferroelectric film 140 is deposited with a thickness of 0.35–0.45 μm.

Figure 3B:
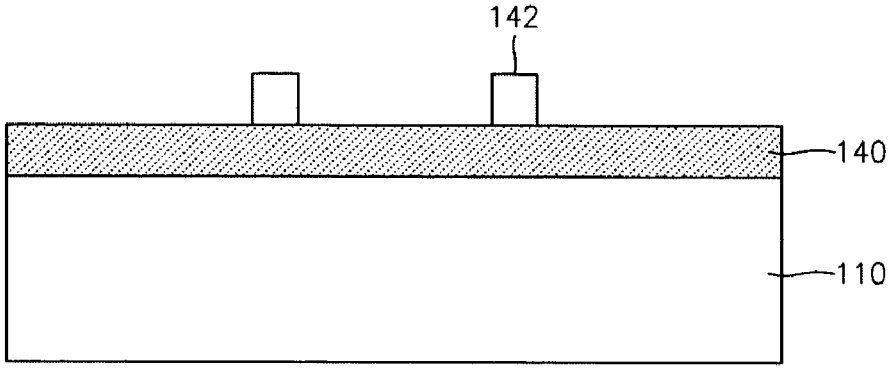

As shown in FIG. 3B, a photoresist pattern 142 is formed on the ferroelectric film 140, using a well-known photolithography process. It is preferable that the photoresist pattern 142 be formed in an area in which the IDC 150 is to be formed.

Figure 3C:
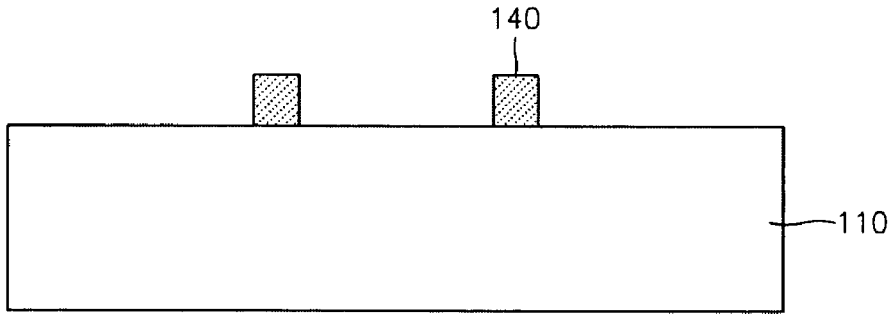

As shown in FIG. 3C, the ferroelectric film 140 is etched in the form of the photoresist pattern 142, thus to form the ferroelectric pattern 140. The ferroelectric film 140 may be etched using RF ion milling. Then the photoresist pattern 142 is removed using a well-known method.

Figure 3D:
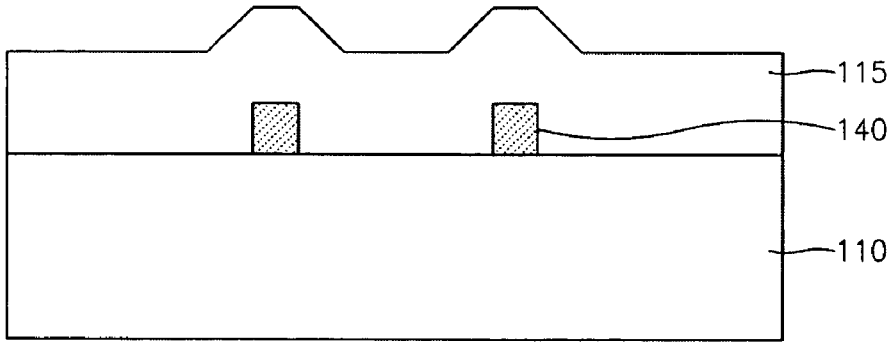

Thereafter, as shown in FIG. 3D, a metal layer 115, e.g., a deposition layer of gold/chrome, is deposited with a thickness of approximately 1.5–2.5 μm using DC magnetron sputtering to form a CPW signal line and a CPW ground plane.

Figure 3E:
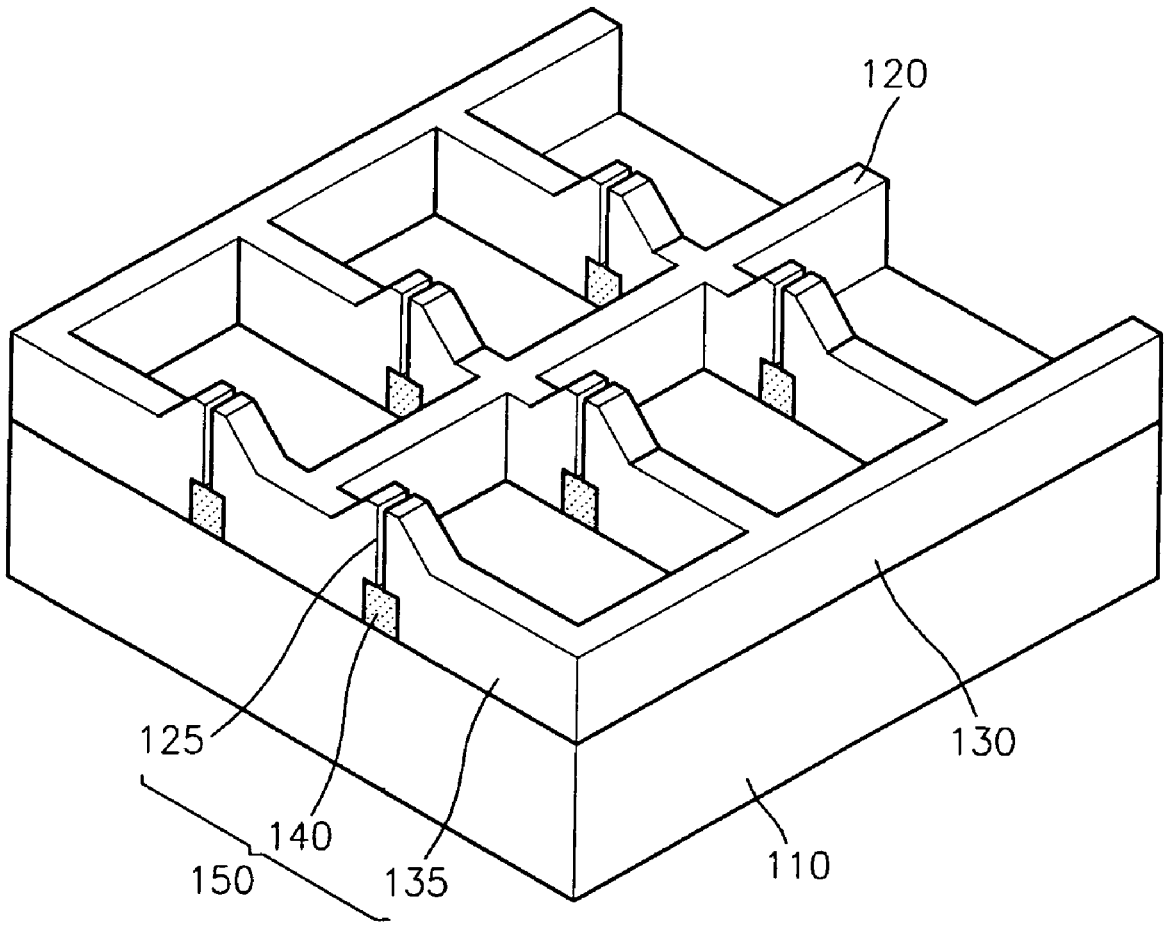

As shown in FIG. 3E, a portion of the metal layer is etched to form the CPW signal line 120, the first electrodes 125, the CPW ground plane 130, and the second electrodes 135. At this time, the first electrodes 125 and the second electrodes 135 are formed such that predetermined portions of the first electrodes 125 and second electrodes 135 overlap with the ferroelectric pattern 140.

Figure 4A:
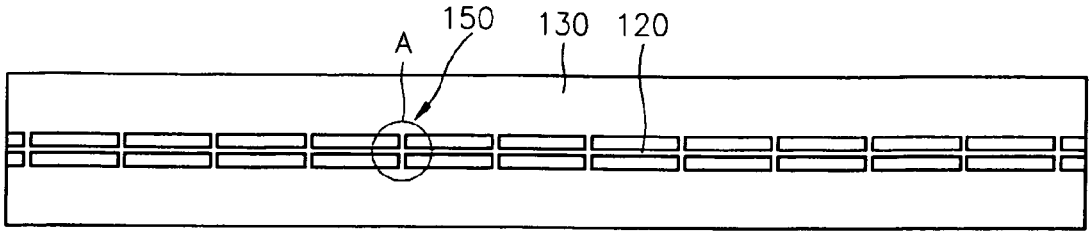
FIG. 4A illustrates the ferroelectric distributed analog phase shifter according to the embodiment of the present invention.
Figure 4B:
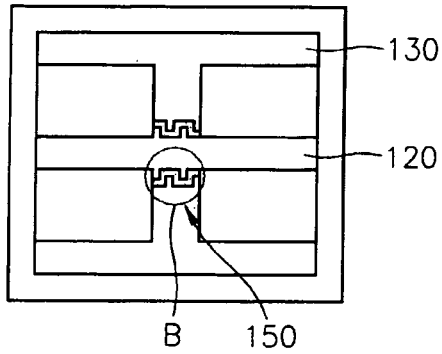
FIG. 4B is an enlarged view of a portion A of FIG. 4A.
Figure 4C:
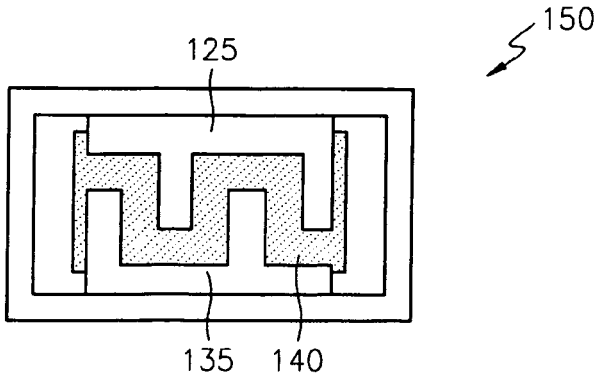
FIG. 4C is an enlarged view of a portion B of FIG. 4B.

FIG. 4A illustrates the ferroelectric distributed analog phase shifter 100 according the embodiment of the present invention, FIG. 4B is an enlarged view of a portion A of FIG. 4A, and FIG. 4C is an enlarged view of a portion B of FIG. 4B.

Referring to FIGS. 4A through 4C, the CPW signal line 120 is disposed between the CPW ground plane 130 and the IDC 150 is disposed between the CPW signal line 120 and the CPW ground plane 130 at predetermined intervals. The IDC 150 overlaps with the first electrodes 125 branched from the CPW signal line 120, the second electrodes 135 branched from the CPW ground plane 130, the first electrodes 125, and the second electrodes 135 and is formed of the ferroelectric pattern 140 having a pattern shape. The first electrodes 125 and the second electrodes 135 are apart by a predetermined distance and may have curved cross-sections such that they can be inserted into each other.

Figure 5:
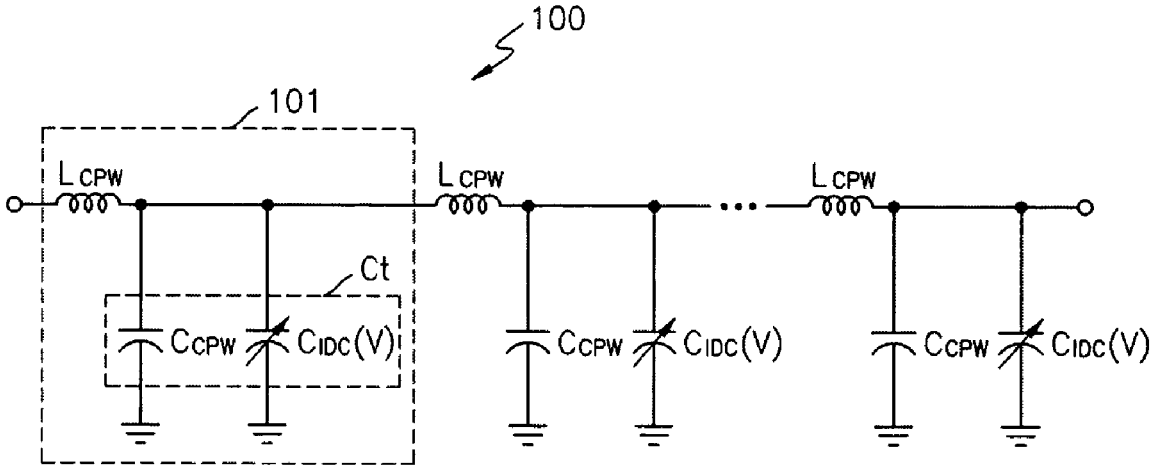
FIG. 5 is an equivalent circuit diagram of a distributed analog phase shifter according to the present invention.

The ferroelectric distributed analog phase shifter 100 can be expressed by an equivalent circuit as shown in FIG. 5.

As shown in FIG. 5, the ferroelectric distributed analog phase shifter 100 includes inductors $L_{CPW}$ connected in series at predetermined intervals and total capacitors $C_t$ connected between the inductors $L_{CPW}$ at predetermined intervals.

The inductors $L_{CPW}$ are generated by the CPW.

Each of the total capacitor $C_t$ includes a fixed capacitor $C_{CPW}$ and a variable capacitor $C_{IDC}$ (V) connected in parallel. The fixed capacitor $C_{CPW}$ is generated between the CPW signal line 120 and the CPW ground plane 130 and does not depend on a voltage. The variable capacitor $C_{IDC}$ (V) includes the first electrodes 125 of the CPW signal line 120, the second electrodes 135 of the CPW ground plane 130, and the ferroelectric pattern 140. Since a dielectric constant of the ferroelectric pattern 140 changes with a voltage applied between the first electrodes 125 and the second electrodes 135, a capacitance changes with the applied voltage.

Therefore, the CPW to which the IDC 150 is periodically connected is regarded as a synthetic transmission line having a line capacitance increased by the capacitance of the IDC 150 per unit cell (cell 101 formed of one inductor and one total capacitor). As a result, characteristic impedance and phase velocity of a synthetic transmission line are changed by the applied voltage.

The characteristic impedance and phase speed of the ferroelectric distributed analog phase shifter 100 are expressed as follows.

$$Z_{S.T.L.}(V) = \sqrt{\frac{L_{CPW}}{(C_{CPW} + C_{IDC}(V)/L_{\text{unit_cell}})}} \tag{1}$$

$$V_{S.T.L.}(V) = \frac{1}{\sqrt{L_{CPW}(C_{CPW} + C_{IDC}(V)/L_{\text{unit_cell}})}},$$

where $Z_{S.T.L.}$(V) represents the characteristic impedance of the synthetic transmission line, $V_{S.T.L.}$(V) represents the phase velocity of the integrated transmission line, $L_{unit_cell}$ represents a distance between the IDC 150, $C_{CPW}$ and $L_{CPW}$ represent values obtained by normalizing a line capacitance and an inductance of the CPW to which the IDC 150 is not connected, using the distance between the IDC 150, i.e., $L_{unit_cell}$, and $C_{IDC}$(V) represents a capacitance of a voltage variable IDC connected to the CPW. It can be seen from Equation 1 that the characteristic impedance and phase velocity of the synthetic transmission line are a function of the applied voltage.

Major design parameters of the distributed analog phase shifter, i.e., the characteristic impedance ($Z_{S.T.L.}$(V)) of the CPW and the distance ($L_{unit_cell}$) between the IDC 150 are optimized such that they are impedance-matched when the capacitance ($C_{IDC}$(V)) of the IDC 150 has the largest value, so as to reduce a change in insertion loss with respect to the change in the applied voltage considering that dielectric loss of a ferroelectric material is maximized when a voltage applied to the ferroelectric material is 0V, i.e., the capacitance of the IDC 150 that is a variable capacitor, is maximized.

To meet the minimum insertion loss condition of the distributed analog phase shifter, in this embodiment, the characteristic impedance of the CPW is set to 70–80Ω, and preferably, to 74Ω (related contents are disclosed in IEEE trans MTT, 47, 1705(1999) by A. S. Nagra and R. A. York). Also, considering total size and metal loss of a circuit, the width of the CPW is be set to 40–60 μm, and preferably, to 50 μm. Thus, to meet a characteristic impedance of 74Ω, a gap between the CPW signal line 120 and the CPW ground plane 130 may be set to 93 μm on a MgO substrate having a thickness of 0.5 mm.

In general, a circuit having a periodic structure has a Bragg frequency and shows a desired characteristic only at frequencies less than the Bragg frequency. In this embodiment, the Bragg frequency is expressed as follows.

$$f_{bragg} = \frac{1}{\pi L_{\text{unit_cell}}\sqrt{L_{CPW}(C_{CPW} + C_{IDC}^{\text{MAX}}/L_{\text{unit_cell}})}}, \tag{2}$$

where $$C_{IDC}^{\text{MAX}}$$

represents the maximum capacitance of the IDC 150. To obtain a Bragg frequency sufficient to use the distributed analog phase shifter in an X band, the maximum capacitance of the IDC 150 using the ferroelectric film is set to 0.08 pF. By using this maximum capacitance, the Bragg frequency and the distance ($L_{unit_cell}$) between the IDC 150 have a relationship as follows.

$$L_{\text{unit_cell}} = \frac{50}{\pi f_{bragg} L_{CPW}}, \tag{3}$$

Using Equation 3, the distance ($L_{unit_cell}$) between the IDC 150 may be set to about 0.65 mm. Thus, a parameter that is not set in the entire circuit is the structure of the IDC 150 having a maximum capacitance of 0.08 pF. Since the IDC 150 is connected to the CPW signal line 120 in parallel, the single IDC 150 should have a maximum capacitance of about 0.04 pF. Inventors of the present invention designed, manufactured, and tested IDCs having various structures to obtain the IDC having a maximum capacitance of about 0.04 pF. As a result, as shown in FIGS. 1 and 2, the IDC 150 is branched from both sides of the CPW signal line 120 in a finger form and the ferroelectric film exists in a pattern form. Also, it can be seen that a capacitance of 0.04 pF is obtained when the overlapping length of fingers disposed in the first electrodes 125 and the second electrodes 135, the width of each of the fingers (the first electrodes 125 and the second electrodes 135), and the gap between the fingers are 5 μm, respectively.

Figure 6A:
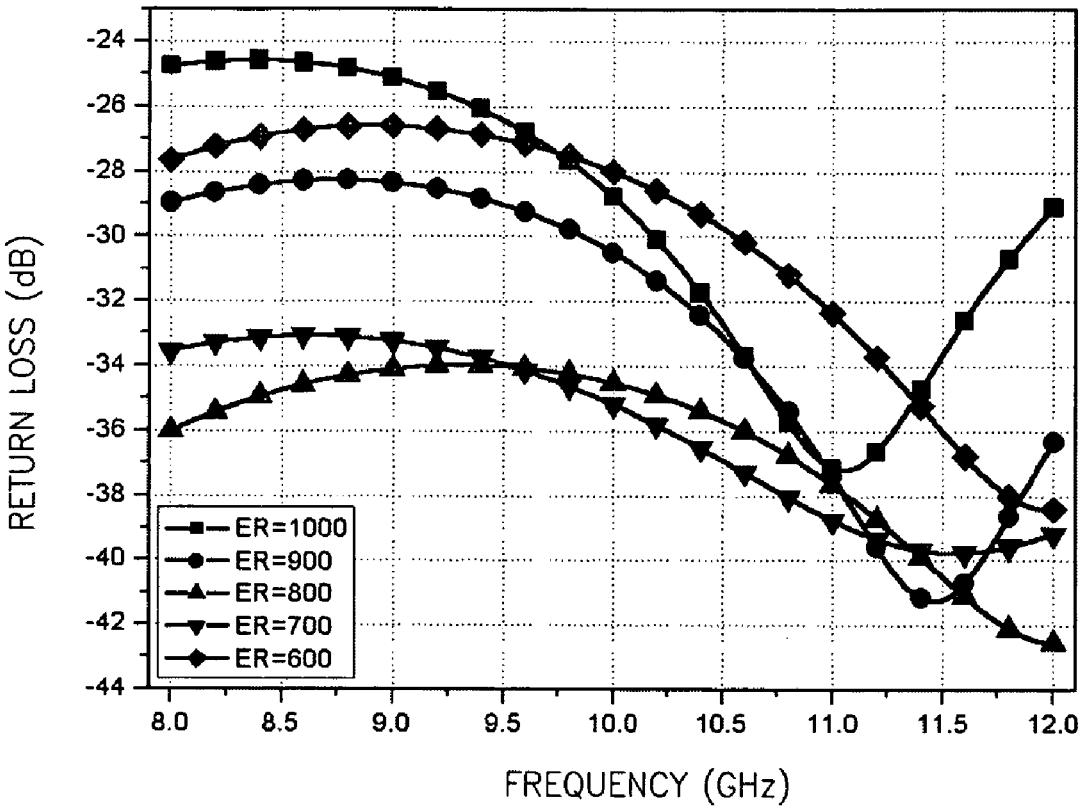
FIG. 6A is a graph showing simulated return loss results with respect to frequencies for the distributed analog phase shifter according to the embodiment of the present invention.
Figure 6B:
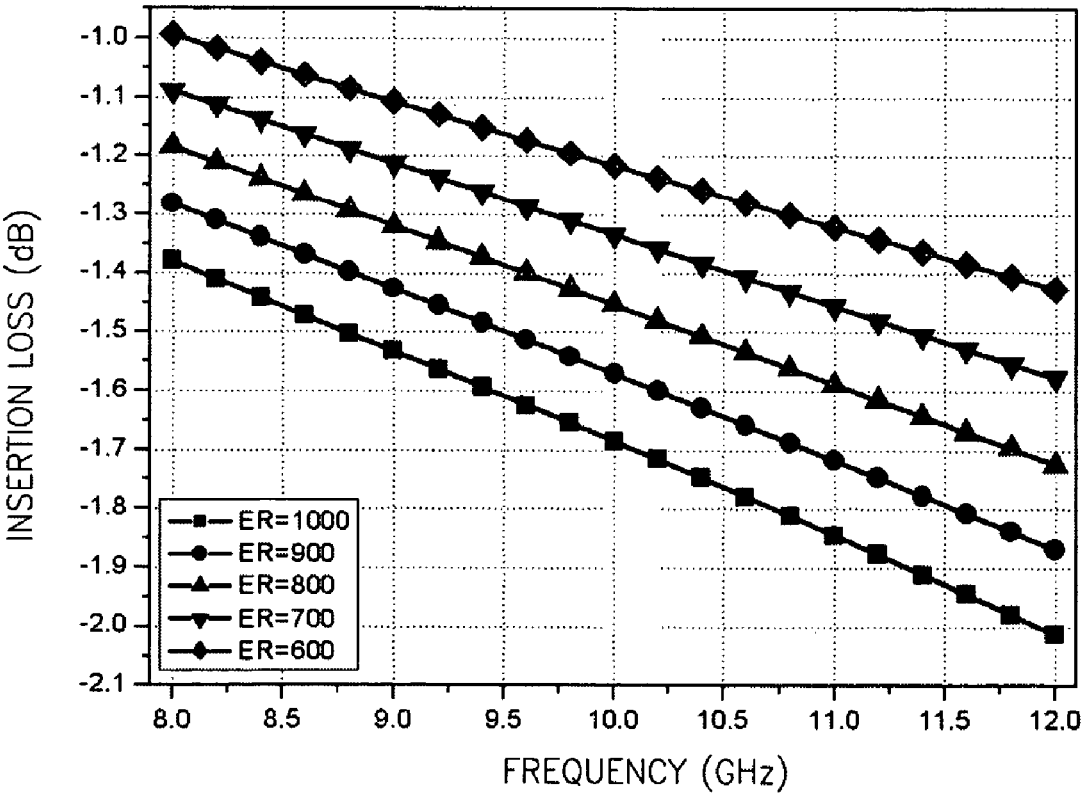
FIG. 6B is a graph showing simulated insertion loss results with respect to frequencies for the distributed analog phase shifter according to the embodiment of the present invention.
Figure 6C:
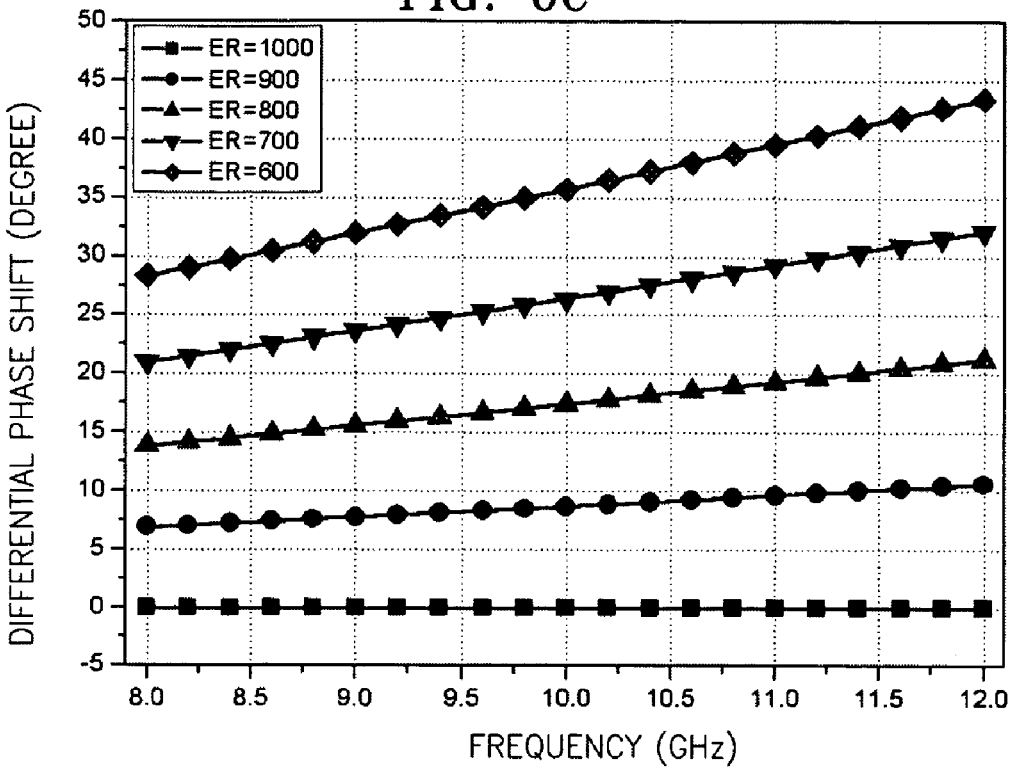
FIG. 6C is a graph showing simulated differential phase shift results with respect to frequencies for the distributed analog phase shifter according to the embodiment of the present invention.

FIGS. 6A through 6C are graphs showing HFSS simulation results to estimate characteristics of the distributed analog phase shifter 100 according to the embodiment of the present invention. In simulation, a required dielectric constant of the ferroelectric material is extracted from a physical structure of the IDC and a measurement result using a conformal mapping technique. As a result, simulation is performed in an environment that a dielectric constant $\epsilon_R$ is verified in a range of 1000–600 with respect to the applied voltage and loss tangent of the ferroelectric material is fixed to 0.1 regardless of the applied voltage in consideration of the worst state thin film.

FIG. 6A is a graph showing simulated return loss results with respect to frequencies for the distributed analog phase shifter 100 according to the embodiment of the present invention. It can be seen from FIG. 6A that return loss is maintained at about −25 dB or more at 10 GHz. FIG. 6B is a graph showing simulated insertion loss results with respect to frequencies for the distributed analog phase shifter 100 according to the embodiment of the present invention. It can be seen from FIG. 6B that insertion loss changes from −1.7 dB to −1.2 dB at 10 GHz. FIG. 6C is a graph showing simulated differential phase shift results with respect to frequencies for the distributed analog phase shifter 100 according to the embodiment of the present invention. It can be seen from FIG. 6C that differential phase shift is 36° at 10 GHz.

Figure 7A:
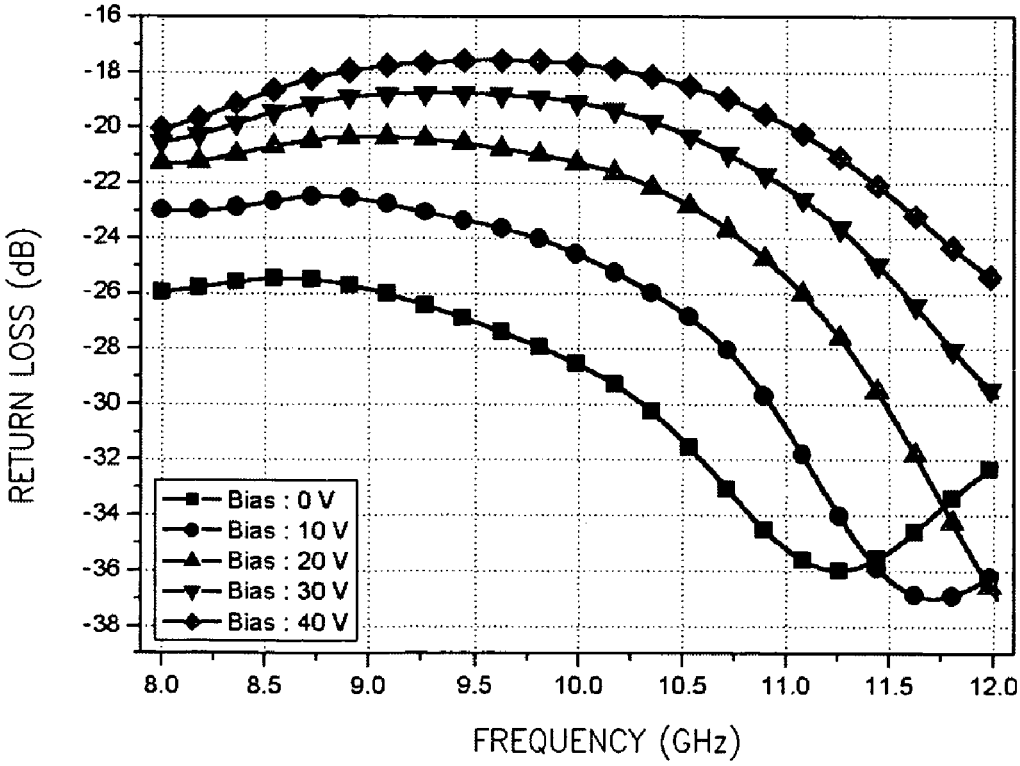
FIG. 7A is a graph showing measured return loss results with respect to frequencies for a distributed analog phase shifter manufactured according to the embodiment of the present invention.
Figure 7B:
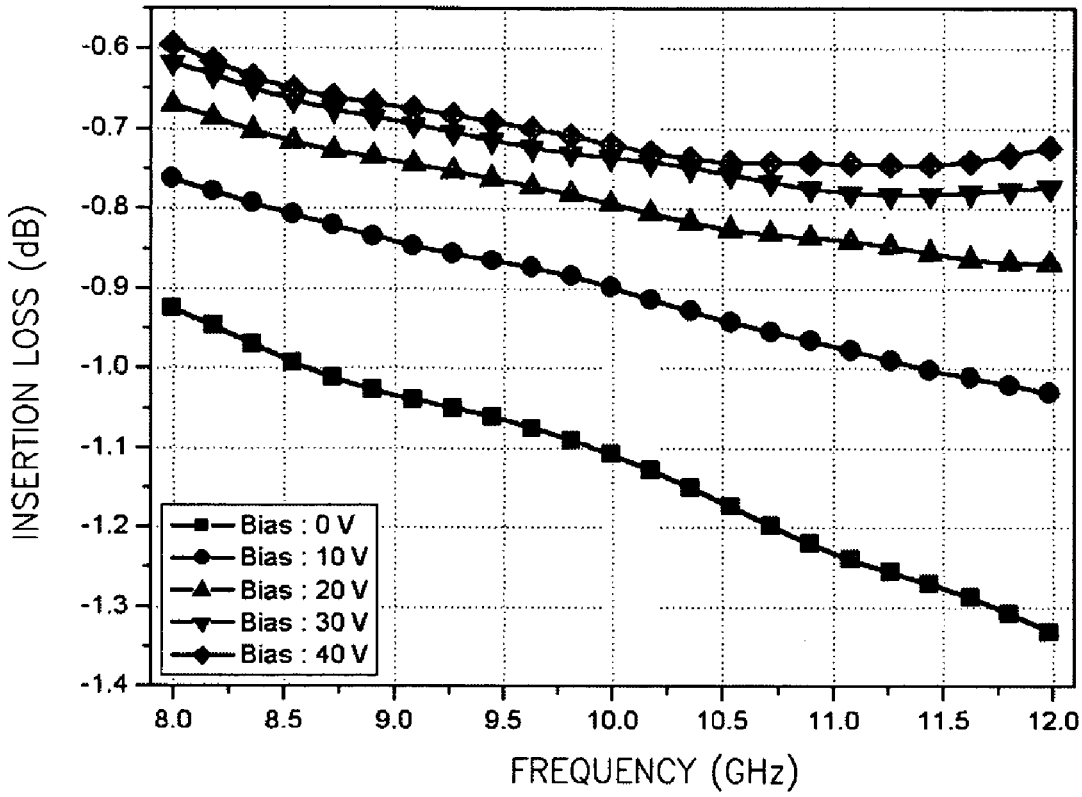
FIG. 7B is a graph showing measured insertion loss results with respect to frequencies for the distributed analog phase shifter manufactured according to the embodiment of the present invention.
Figure 7C:
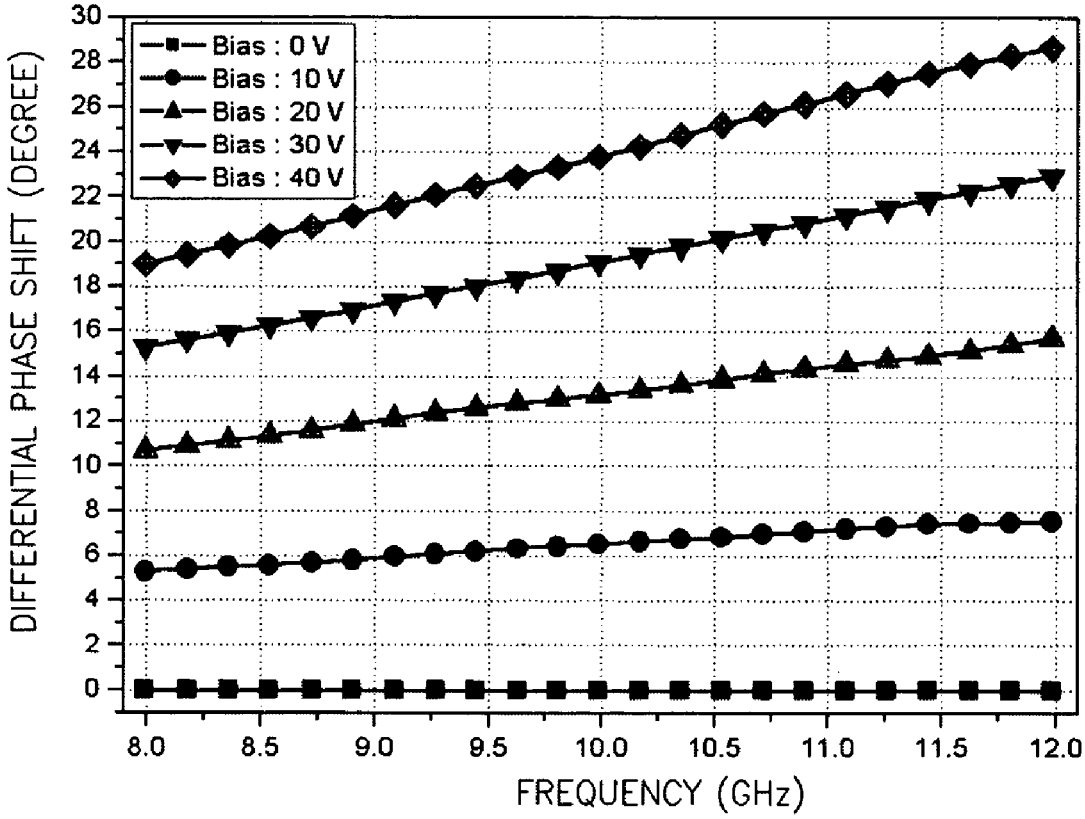
FIG. 7C is a graph showing measured differential phase shift results with respect to frequencies for the distributed analog phase shifter manufactured according to the embodiment of the present invention.

FIGS. 7A through 7C are graphs showing measured return loss, insertion loss, and differential phase shift when an applied voltage Bias ranges from 0V to 40V for a ferroelectric distributed analog phase shifter manufactured according to the embodiment of the present invention. An RF characteristic of the ferroelectric distributed analog phase shifter is measured using an HP8510C vector network analyzer and a GSG pico-probe.

In practice, a device has a return loss of −17 dB or more over the entire bands as shown in FIG. 7A, an insertion loss that changes from −1.1 dB to −0.7 dB at 10 GHz as shown in FIG. 7B, and a differential phase shift of 24° at 10 GHz. At this time, differential phase shift can be increased by increasing the number of unit cell 101 of the ferroelectric distributed analog phase shifter.

When comparing FIGS. 6A through 6C with FIGS. 7A through 7C, it can be seen that simulated results are similar to return loss and differential phase shift of the actual device. In the case of insertion loss, simulated results are greater than insertion loss of the actual device. However, since simulation is performed in consideration of the worst-case scenario where loss tangent of the ferroelectric material is set to a relatively high value, i.e., 0.1, it is expected that there is no large difference in insertion loss in practice.

The ferroelectric distributed analog phase shifter according to the present invention etches a ferroelectric film and uses the etched ferroelectric film as a pattern form, thereby achieving accuracy in variable RF device desig and reducing total insertion loss of the device.

The art and spirit of the present invention are described in detail according to the embodiment of the present invention, however, should not be construed as being limited to the embodiment set forth herein. For example, in the above embodiment, an X-band distributed analog phase shifter is described as an example, but the present invention can be applied without restriction of a band.

Also, partial etching of the ferroelectric film can be applied to any RF variable device using a ferroelectric film.

As described above, according to the present invention, by controlling a distance (gap) between first electrodes and second electrodes of an IDC which is connected to a CPW, a change in the strength of an electric field applied to the ferroelectric film is maintained constantly and an operating applied voltage of the phase shifter using the ferroelectric film can be reduced without a change in a characteristic of a circuit.

As described above, according to the present invention, a change in a characteristic impedance while maintaining the change in the phase velocity of the ferroelectric distributed analog phase shifter with respect to an applied voltage can be minimized and an operating applied voltage of the phase shifter using the ferroelectric film can be reduced without a change in a characteristic of a circuit.

Also, by partially etching the ferroelectric film, accuracy in RF variable device design is improved, thereby improving a return loss characteristic of the device and reducing total insertion loss of the device.

While the present invention has been particularly shown and described with reference to an exemplary embodiment thereof, it will be understood by those of ordinary skill in the art that various changes in form and details may be made therein without departing from the spirit and scope of the invention as defined by the appended claims and their equivalents.

What is claimed is:

1. A method of manufacturing a distributed analog phase shifter, the method comprising:

(a) depositing a ferroelectric film on a substrate;

(b) etching the ferroelectric film to form ferroelectric patterns;

(c) depositing a metal layer on the substrate on which the ferroelectric patterns have been formed; and (d) forming a coplanar waveguide, first electrodes, a ground line, and second electrodes by etching the metal layer covering the ferroelectric patterns, wherein the first electrodes and the second electrodes are formed such that portions of the first electrodes and second electrodes overlap with the ferroelectric pattern, respectively.

2. The method of claim 1, wherein the ferroelectric film is deposited using pulsed laser deposition.

3. The method of claim 1, wherein the ferroelectric film is etched using radio frequency ion milling.

4. The method of claim 1, wherein the metal layer is a deposition layer of gold/chrome.

5. The method of claim 4, wherein the metal layer is deposited using DC magnetron sputtering.

* * * * *